US010368603B2

(12) United States Patent
Liu

(10) Patent No.: US 10,368,603 B2
(45) Date of Patent: Aug. 6, 2019

(54) LUMINOUS HELMET AND MANUFACTURING METHOD THEREOF

(71) Applicant: SHENZHEN QIANHAI LIVALL IOT TECHNOLOGY CO., LTD., Shenzhen, Guangdong Province (CN)

(72) Inventor: Kenneth Liu, Shenzhen (CN)

(73) Assignee: ShenZhen Qianhai LIVALL IOT Technology CO., LTD., ShenZhen, GuangDong Province (CN)

( * ) Notice: Subject to any disclaimer, the term of this patent is extended or adjusted under 35 U.S.C. 154(b) by 0 days.

(21) Appl. No.: 15/744,765

(22) PCT Filed: Feb. 4, 2016

(86) PCT No.: PCT/CN2016/073424

§ 371 (c)(1),
(2) Date: Jan. 13, 2018

(87) PCT Pub. No.: WO2017/071141

PCT Pub. Date: May 4, 2017

(65) Prior Publication Data

US 2018/0206578 A1 Jul. 26, 2018

(30) Foreign Application Priority Data

Oct. 9, 2015 (CN) ..... 2015 1 0647636

(51) Int. Cl.

| | |
|---|---|
| ***A42B 3/00*** | (2006.01) |
| ***A42B 3/04*** | (2006.01) |
| ***A42C 2/00*** | (2006.01) |

(52) U.S. Cl.

CPC ..... *A42B 3/044* (2013.01); *A42C 2/002* (2013.01); *A42C 2/005* (2013.01)

(58) Field of Classification Search

CPC ..... A42C 2/002; A42C 2/005; A42B 3/044
USPC ..... 362/105
See application file for complete search history.

(56) References Cited

U.S. PATENT DOCUMENTS

| | | | | |
|---|---|---|---|---|
| 5,508,900 A * | 4/1996 | Norman | A42B 3/0406 2/422 |
| 5,743,621 A * | 4/1998 | Mantha | A42B 3/044 362/105 |
| 5,871,271 A * | 2/1999 | Chien | A42B 3/044 362/103 |
| 6,464,369 B1 * | 10/2002 | Vega | A42B 3/044 362/105 |

(Continued)

FOREIGN PATENT DOCUMENTS

| | | | |
|---|---|---|---|
| CN | 201352968 | * 12/2009 | A42B 3/04 |

*Primary Examiner* — Julie A Bannan
(74) *Attorney, Agent, or Firm* — Jeanette Meng Nakagawa

(57) ABSTRACT

The present disclosure is for a luminous helmet, comprising an outer shell configured to fit over a human head, an inner shell, a light-emitting band arranged along an elongated slit opening on the outer shell, and a light transmitting groove enclosing the light emitting band. In the manufacturing process, the outer shell was formed first, with a slit cut to match the light transmitting groove. The light-transmitting groove, comprising fixing grooves, engage fixing strips extending from edges of the outer shell along the slit opening. This structure then serves as a base to house the light-emitting band, and to receive pressure injection of the inner shell material.

7 Claims, 5 Drawing Sheets

(56) References Cited

U.S. PATENT DOCUMENTS

| | | | | |
|---|---|---|---|---|
| 6,784,795 | B1 * | 8/2004 | Pories | A42B 3/0453 340/464 |
| 8,350,486 | B2 * | 1/2013 | Bucalo | H05B 33/0803 315/209 R |
| 8,529,082 | B1 * | 9/2013 | Baker | F21V 33/0076 362/105 |
| 8,807,778 | B1 * | 8/2014 | Latchman | A42B 3/0453 362/105 |
| 9,968,153 | B2 * | 5/2018 | Thompson | A42B 3/044 |
| 2007/0194558 | A1 * | 8/2007 | Stone | A63C 5/003 280/601 |

* cited by examiner

LUMINOUS HELMET AND MANUFACTURING METHOD THEREOF

FIELD OF THE INVENTION

The present invention relates to the technical field of bicycle motion protection and safeguard equipment, and in particular to a luminous helmet and a manufacturing method thereof.

BACKGROUND OF THE INVENTION

In order to protect the head, a helmet is required to withstand certain impact strength, and cannot be too heavy to affect the use at the same time, therefore the existing helmet generally includes an outer shell made of PC and an inner shell made of EPS and other lightweight materials. The outer shell is made of the PC by blister forming, and the EPS and other lightweight materials are subjected to pressure injection to form a helmet main body with the outer shell.

Usually, for the beautiful appearance of the helmet, the colorless PC material needs to be colored, the shape of the PC material is irregular after the blister forming, and the coloring difficulty on the outer shell is high, therefore the PC material needs to be colored by silk screen printing, coating and other manner prior to the blister forming. With respect to the existing luminous helmet with pre-embedded LED light bars, blanks need to be reserved on positions of the pre-embedded LED light bars, namely blanks are reserved and are not colored for the transmission of light. As the blanks need to be reserved prior to the blister forming of the PC material, deformation is generated during the blister forming of the PC material, therefore the blank areas may be subjected to deviation, resulting in deviation between the positions of the reserved blanks and the positions of the pre-embedded LED light bars, which not only affects the light emission effect, but also affects the beautiful appearance, and accordingly the percent defective in helmet production is increased.

SUMMARY OF THE INVENTION

The main technical problem to be solved by the present invention is to provide a luminous helmet and a manufacturing method thereof. The luminous helmet can prevent deviation between an uncolored blank area of a light transmission position and a light emission position of a formed outer shell from affecting the beautiful appearance and quality of the product in a production process, and the production efficiency of the luminous helmet is improved.

In order to solve the above technical problem, the present invention provides a luminous helmet, including an outer shell and an inner shell in joint connection with the outer shell, a light emitting band is arranged between the inner shell and the outer shell, wherein the outer shell is provided with a strip-shaped fixing hole at the position of the light emitting band, a light transmission groove for accommodating the light emitting band is formed in the fixing hole, and an extension part extending toward the outer side is arranged at the opening of the light transmission groove.

Further, the section of the light transmission groove in a direction vertical to the length is n-shaped.

Further, a coordination structure is arranged between the light transmission groove and the fixing hole, the coordination structure includes a fixing groove formed in the extension part of the light transmission groove, and a fixing strip extending toward the inner side and coordinating with the fixing groove is arranged on the edge of the fixing hole.

Further, the light emitting band includes an FPC board and at least one LED lamp arranged on the FPC board.

Further, the inner side of the outer shell is further provided with a coloring layer and a protection layer arranged on the coloring layer, and an adhesion layer is arranged on the protection layer or the inner shell.

The present invention further provides a luminous helmet manufacturing method, including:

an outer shell and light transmission groove forming step: completely coloring the inner side of a PC sheet of an outer shell base material, carrying out blister forming to form an outer shell, and carrying out blister forming on the PC sheet of a light transmission groove base material to form a light transmission groove;

a fixing hole forming step: cutting the outer shell at a proper position to form a fixing hole matched with the light transmission groove;

a light transmission groove fixing step: fixing the light transmission groove with the inner side of the outer shell, exposing the bottom of the light transmission groove from the surface of the outer shell by penetrating through the fixing hole, and fixing the edge of the opening of the light transmission groove with the edge of the fixing hole;

a light emitting band fixing step: fixing a light emitting band in the light transmission groove, and locating a light emitting surface of an LED lamp on the light emitting band at the bottom of the light transmission groove; and a helmet forming step: placing the light transmission groove in which the light emitting band is fixed and the outer wall in an inner shell forming mold, injecting an inner shell material, and carrying out pressure injection to form the helmet.

Further, the inner side of the outer shell is further provided with a coloring layer and a protection layer arranged on the coloring layer, and an adhesion layer is arranged on the protection layer or the inner shell.

Further, during the blister forming of the outer shell, an inward groove is formed in the surface of the outer shell, and a fixing strip composed of a part of groove walls is formed by cutting a side wall of the groove.

Further, the section of the light transmission groove in a direction vertical to the length is n-shaped.

Further, the depth of the fixing groove is equivalent to the height of the fixing strip.

Further, the light emitting band is provided with an FPC of at least one LED lamp.

The present invention further provides a luminous helmet manufacturing method, including:

an outer shell forming step: carrying out blister forming on a PC sheet of a colored outer shell base material to form an outer shell with a groove;

a fixing hole forming step: cutting the outer shell at a proper position to form a fixing hole matched with a light transmission groove;

a light transmission groove forming step: carrying out blister forming on the PC sheet of a light transmission groove base material to form the light transmission groove matched with the fixing hole;

a light transmission groove fixing step: fixing the light transmission groove with the inner side of the outer shell, exposing the bottom of the light transmission groove from the surface of the outer shell by penetrating through the fixing hole, and fixing the edge of the opening of the light transmission groove with the edge of the fixing hole;

a light emitting band fixing step: fixing a light emitting band in the light transmission groove, and locating a light emitting surface of an LED lamp on the light emitting band at the bottom of the light transmission groove; and a helmet forming step: placing the light transmission groove in which the light emitting band is fixed and the outer wall in an inner shell forming mold, injecting an inner shell material, and carrying out pressure injection to form the helmet.

The luminous helmet of the present invention includes the outer shell and the inner shell in joint connection with the outer shell, the light emitting band is arranged between the inner shell and the outer shell, the outer shell is provided with the strip-shaped fixing hole at the position of the light emitting band, the light transmission groove for accommodating the light emitting band is formed in the fixing hole, and the extension part extending toward the outer side is arranged at the opening of the light transmission groove. During the blister forming of the outer shell, the blister forming is carried out after the whole PC sheet is colored, the area requiring light transmission is cut to form the fixing hole, and the light transmission groove and the fixing hole are fixed to form a light transmission structure. No light transmission blank area needs to be arranged on the PC sheet, thereby preventing the deviation between the uncolored blank area of the light transmission position and the light emission position of the formed outer shell in the production process from affecting the beautiful appearance and quality of the product, improving the production efficiency of the luminous helmet and reducing the production cost.

BRIEF DESCRIPTION OF THE DRAWINGS

To illustrate technical solutions in the embodiments of the present invention or in the prior art more clearly, a brief introduction on the accompanying drawings which are needed in the description of the embodiments or the prior art is given below. Apparently, the accompanying drawings in the description below are merely some of the embodiments of the present invention, based on which other accompanying drawings can be obtained by those of ordinary skill in the art without any creative effort.

The objective implementation, functional characteristics and advantages of the present invention will be further described below in combination with embodiments and with reference to the accompanying drawings.

DETAILED DESCRIPTION OF THE EMBODIMENTS

In order that the objectives, technical solutions and advantages of the present invention are clearer, a clear and complete description of technical solutions in the embodiments of the present invention will be given below, in combination with the accompanying drawings in the embodiments of the present invention. Apparently, the embodiments described below are merely a part, but not all, of the embodiments of the present invention. All of other embodiments, obtained by those of ordinary skill in the art based on the embodiments of the present invention without any creative effort, fall into the protection scope of the present invention.

Figure 1:
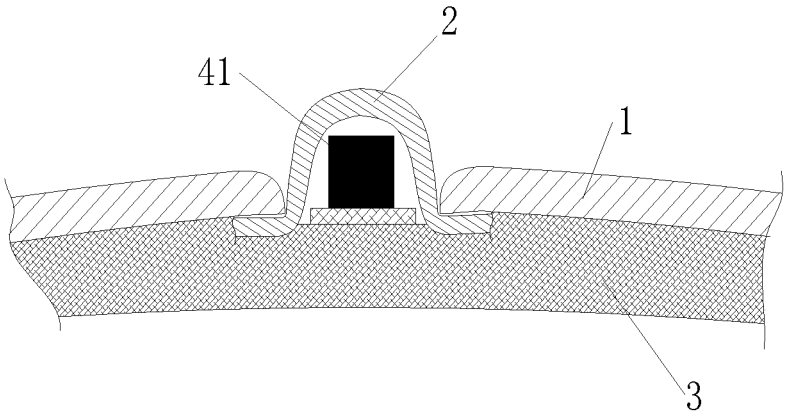
FIG. 1 is a sectional schematic diagram of a structure of an embodiment of a luminous helmet.
Figure 2:
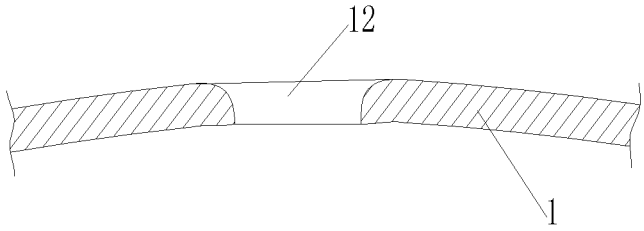
FIG. 2 is a sectional schematic diagram of a structure of an embodiment of an outer shell at the position of a fixing hole.
Figure 3:
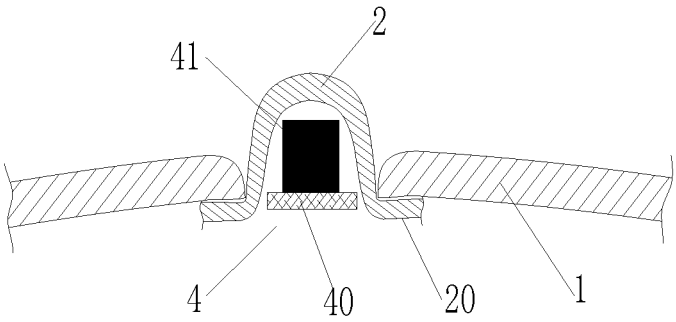
FIG. 3 is a sectional schematic diagram of a structure after the fixing hole is matched with a light transmission groove.
Figure 4:
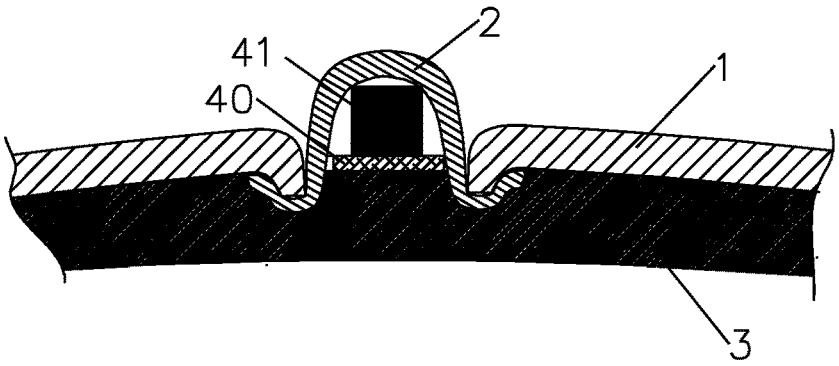
FIG. 4 is a sectional schematic diagram of a structure of another embodiment of the luminous helmet.
Figure 5:
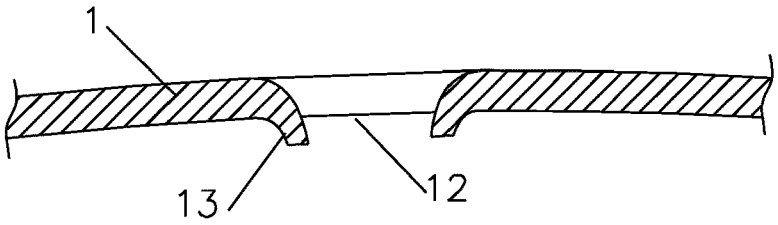
FIG. 5 is a sectional schematic diagram of a structure of another embodiment of the fixing hole.
Figure 6:
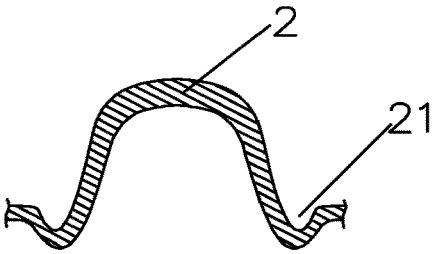
FIG. 6 is a sectional schematic diagram of a structure of another embodiment of the light transmission groove.
Figure 7:
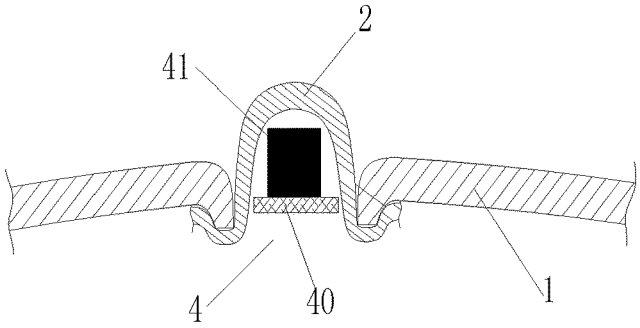
FIG. 7 is a sectional schematic diagram of a structure in coordination with another embodiment of the light transmission groove on the basis of FIG. 5.

As shown in FIG. 1 to FIG. 3, the present invention provides an embodiment of a luminous helmet.

The luminous helmet includes an outer shell 1 and an inner shell 3 in joint connection with the outer shell 1, a light emitting band is arranged between the inner shell 3 and the outer shell 1, the outer shell 1 is provided with a strip-shaped fixing hole 12 at the position of the light emitting band 4, a light transmission groove 2 for accommodating the light emitting band is formed in the fixing hole 12, and an extension part 20 extending toward the outer side is arranged at the opening of the light transmission groove 2.

Specifically, the base material of the outer shell 1 is generally a PC sheet, the PC sheet raw material is colorless, in order to make the helmet be more beautiful, necessary graphs or patterns can be silk screen printed or coated on one side of the PC sheet, and during blister forming, the surface without the graphs or patterns is in contact with a mold, therefore the graphs or patterns will not be damaged during the blister forming.

The inner shell 3 is formed by carrying out pressure injection on an EPS material. The cross section of the light transmission groove 2 in a direction vertical to the length is n-shaped, the bottom, namely a convex surface, of the light transmission groove 2 penetrates through the fixing hole 12, the convex surface is higher than the surface of the outer shell 1, and the edge of the light transmission groove 2 is in contact with the inner side of the outer shell 1, therefore it can be guaranteed that, when the outer shell 1 fixed with the light transmission groove 2 is placed in the mold to from the inner shell by pressure injection, the EPS material is unlikely to expose from the inner shell through a gap between the fixing hole 12 and the light transmission groove 2. The outer shell 1 is generally coated with bright colors, the inner shell material, such as the EPS, is generally coated with gray, or black and gray colors, and when the inner shell 3 is exposed from the middle of the outer shell 1, the beautiful appearance of the product is seriously affected, thereby causing quality defects of the products.

In order to avoid the looseness of the light transmission groove 2 after being placed in the fixing hole 12, the light transmission groove 2 can be well fixed with the outer shell 1 on the n-shaped edge of the light transmission groove 2 through glue and the like, as shown in FIG. 3.

The light emitting band 4 includes an FPC board 40 and LED lamps 41 arranged on the FPC board 40, the number of the LED lamps 41 is set according to demands, for example, one, two or more LED lamps can be arranged. Prior to the pressure injection forming of the inner shell 3, the light emitting band 4 is placed in the light transmission groove 2, therefore a light emitting surface of the LED lamp 41 is close to the bottom of the light transmission groove 2.

As no light transmission blank area needs to be prearranged on the base material PC sheet of the outer shell 1, the following situation can be avoided: the outer shell 1 is influenced by temperature, pressure and the like during the blister forming to cause deviation of a light transmission position of the blank area, and the colored area deviates to a light emission position to affect the beautiful appearance and the quality of the helmet, the production efficiency of the luminous helmet is improved, and the production cost is reduced. The blank area refers to that different graphs, patterns or colors or the like need to be set in the production of the helmet, and in order to enable a light source arranged between the outer shell and the inner shell to emit light from the surface of the helmet, a blank needs to be reserved for the light transmission area when the graphs, patterns or colors or the like are set, so that the light of the light source can emit from the surface of the helmet. Meanwhile, the light emitting band 4 is arranged in the light transmission groove 2, and the light transmission groove 2 is higher than the surface of the outer shell 1, so that the range of the emergent light can be wider.

In order to better fix the light transmission groove 2 and the fixing hole 12 to avoid the deviation during high temperature pressure injection of the inner shell 3, a coordination structure is arranged between the light transmission groove 2 and the fixing hole 12, as shown in FIG. 4 to FIG. 7. The coordination structure includes a fixing groove 21 formed in the edge of the light transmission groove, a fixing strip 13 extending toward the inner side and coordinating with the fixing groove 21 is arranged on the edge of the fixing hole 12, and it is the best that the depth of the fixing groove 21 is equivalent to the height of the fixing strip 13. As the light transmission groove 2 can well fix and limit the fixing strip 13 through the fixing groove 21, even the high temperature generated by the pressure injection of the EPS material to form the inner shell will cause no deviation between the edge of the light transmission groove 2 and the fixing hole 12, resulting in the exposure of the local EPS material to affect the product quality.

In order to avoid the damage to the coloring layer during pressure injection to cause a poor appearance of the outer shell, the coloring can be carried out, but not limited to, coating, silk screen printing and other processes. An adhesion layer is coated at the outside of the protection layer to better fuse and fix the outer shell and the inner shell during the injection molding of the EPS material of the inner layer, therefore the outer shell is unlikely to separate from the inner layer. The adhesion layer can also be directly arranged on the inner side of the outer shell.

Figure 8:
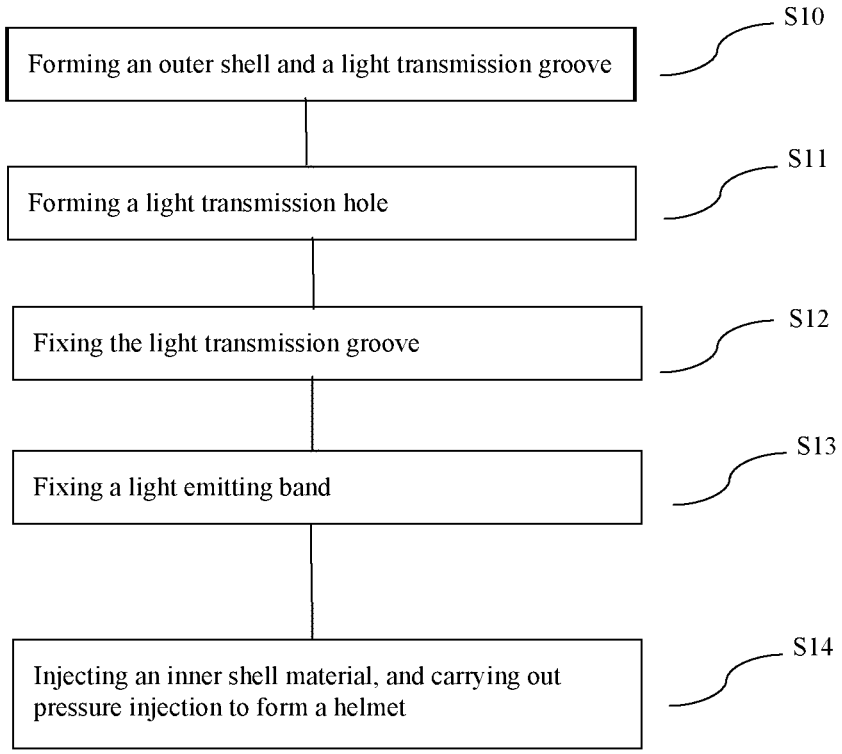
FIG. 8 is a flowchart of a luminous helmet manufacturing method.
Figure 9:
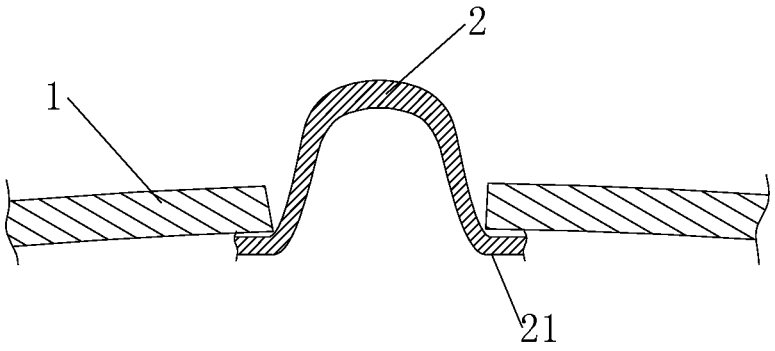
FIG. 9 is a schematic diagram of a structure when a formed outer shell is coordinated with a formed light transmission groove.
Figure 10:
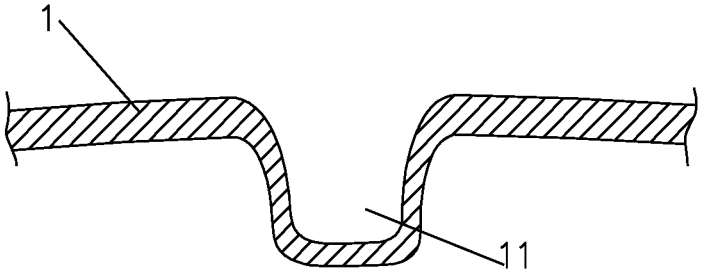
FIG. 10 is a schematic diagram of a structure formed by an outer shell forming step.
Figure 11:
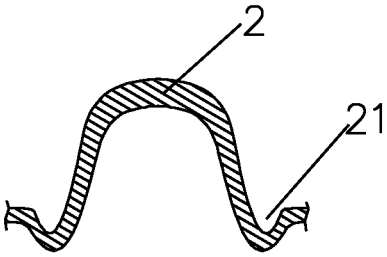
FIG. 11 is a schematic diagram of a structure formed by a light transmission groove forming step.
Figure 12:
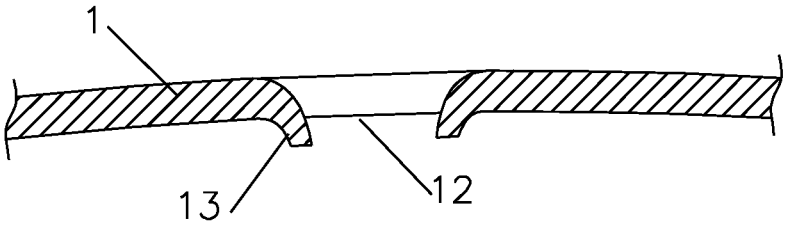
FIG. 12 is a schematic diagram of a structure formed by a fixing hole forming step.
Figure 13:
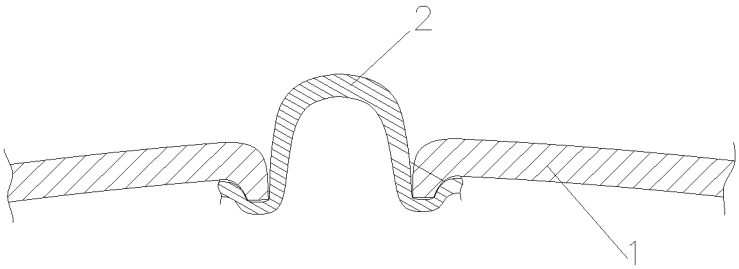
FIG. 13 is a schematic diagram of a structure formed by a light transmission groove fixing step.
Figure 14:
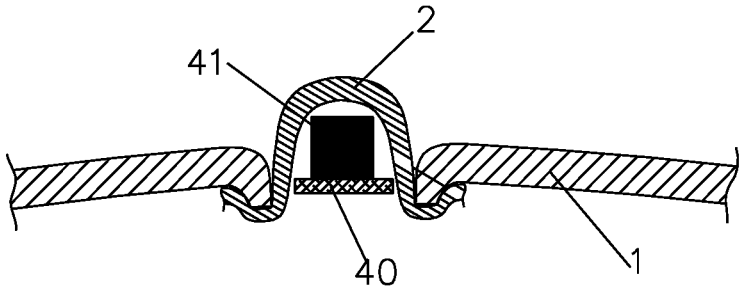
FIG. 14 is a schematic diagram of a structure formed by a light emitting band fixing step.
Figure 15:
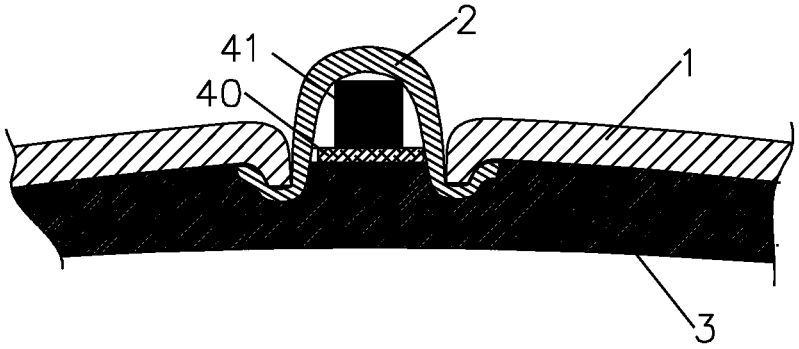
FIG. 15 is a schematic diagram of a structure formed by a helmet forming step.

As shown in FIG. 8, the present invention further provides a luminous helmet manufacturing method, including:

S10, an outer shell and light transmission groove forming step: completely coloring the inner side of a PC sheet of an outer shell base material, carrying out blister forming to form an outer shell, and carrying out blister forming on the PC sheet of a light transmission groove base material to form a light transmission groove, namely taking two PC sheets, completely coloring the inner side of the PC sheet of the outer shell base material, carrying out blister forming on the colored PC sheet to form the outer shell, and carrying out the blister forming on the uncolored PC sheet to form the light transmission groove;

S11, a fixing hole forming step: cutting the outer shell at a proper position to form a fixing hole matched with the light transmission groove;

S12, a light transmission groove fixing step: fixing the light transmission groove with the inner side of the outer shell, exposing the bottom of the light transmission groove from the surface of the outer shell by penetrating through the fixing hole, and fixing the edge of the opening of the light transmission groove with the edge of the fixing hole, as shown in FIG. 9;

S13, a light emitting band fixing step: fixing a light emitting band in the light transmission groove, and locating a light emitting surface of an LED lamp on the light emitting band at the bottom of the light transmission groove, as shown in FIG. 13, wherein the light emitting band includes an FPC board and at least one LED lamp arranged on the FPC board; and

S14, placing the light transmission groove in which the light emitting band is fixed and the outer wall in an inner shell forming mold, injecting an inner shell material, and carrying out pressure injection to form the helmet.

Specifically, in order to avoid the damage to the coloring layer during pressure injection to cause a poor appearance of the outer shell, the coloring can be carried out, but not limited to, coating, silk screen printing and other processes. An adhesion layer is coated at the outside of the protection layer to better fuse and fix the outer shell and the inner shell during the injection molding of the EPS material of the inner layer, therefore the outer shell is unlikely to separate from the inner layer. The adhesion layer can also be directly arranged on the inner side of the outer shell.

In order to ensure better coordination between the fixing hole 12 and the light transmission groove and avoid exposure during the pressure injection of the EPS material in the inner shell to affect the beautiful appearance, a fixing strip 13 is arranged on the fixing hole 12, namely when the fixing hole 12 is formed, a fixing strip composed of a part of groove walls is formed by cutting a side wall of a groove 11, namely, the fixing strip 13 is composed of the part of reserved side walls. The edge of the light transmission groove 2 extends toward the outer side of form an n-shaped section, the fixing grooves 21 are formed in two sides of the n shape, and the depth of the fixing groove 21 is equivalent to the height of the fixing strip 13, as shown in FIG. 10 to FIG. 15.

During the blister forming of the outer shell, the blister forming is carried out after the whole PC sheet is colored, and the area requiring light transmission is cut to form the fixing hole, and the light transmission groove is fixed with the fixing hole to form the light transmission structure. No light transmission blank area needs to be arranged on the PC sheet, thereby preventing the deviation between the uncolored blank area of the light transmission position and the light emission position of the formed outer shell in the production process from affecting the beautiful appearance and quality of the product, improving the production efficiency of the luminous helmet and reducing the production cost.

In the above embodiment, the outer shell forming step and the light transmission groove forming step are in a random order, the light transmission groove forming step can be carried out either prior to or after the outer shell forming step, the light transmission groove forming step can also be carried out after the fixing hole forming step on the outer shell of the groove, and other steps are not changed.

The luminous helmet manufacturing method includes:

an outer shell forming step: carrying out blister forming on a PC sheet of a colored outer shell base material to form an outer shell with a groove;

a fixing hole forming step: cutting the outer shell at a proper position to form a fixing hole matched with a light transmission groove;

a light transmission groove forming step: carrying out blister forming on the PC sheet of a light transmission groove base material to form the light transmission groove matched with the fixing hole;

a light transmission groove fixing step: fixing the light transmission groove with the inner side of the outer shell, exposing the bottom of the light transmission groove from the surface of the outer shell by penetrating through the fixing hole, and fixing the edge of the opening of the light transmission groove with the edge of the fixing hole;

a light emitting band fixing step: fixing a light emitting band in the light transmission groove, and locating a light emitting surface of an LED lamp on the light emitting band at the bottom of the light transmission groove; and a helmet forming step: placing the light transmission groove in which the light emitting band is fixed and the outer wall in an inner shell forming mold, injecting an inner shell material, and carrying out pressure injection to form the helmet.

The above-mentioned embodiments are merely used for illustrating, instead of limiting the technical solutions of the present invention. Although the present invention has been described in detail with reference to the foregoing embodiments, those of ordinary skill in the art should understand that they could still make modifications to the technical solutions recorded in the foregoing embodiments or make equivalent substitutions to a part of technical features, and these modifications or substitutions do not make the essence of the corresponding technical solutions depart from the spirit or scope of the technical solutions of the embodiments of the present invention.

What is claimed is:

1. A luminous helmet, comprising:

an outer shell configured to fit over a human head;

an inner shell connected to the outer shell;

a light emitting band arranged along an elongated slit opening on the outer shell;

a light transmitting groove enclosing the light emitting band, wherein the light transmitting groove further comprises at least one fixing groove complimentarily engaged with at least one fixing strip extending from an edge of the outer shell along the slit opening.

2. The luminous helmet of claim 1, wherein the light emitting band comprises an FPC board and at least one LED lamp arranged on the FPC board.

3. The luminous helmet of claim 1, wherein a coloring layer and a color protection layer on top are adhesively arranged between the outer shell and the inner shell.

4. A luminous helmet manufacturing method, comprising:

an outer shell and light transmission groove forming step: completely coloring an inner side of a PC sheet of an outer shell base material, carrying out blister forming to form an outer shell, and carrying out blister forming on the PC sheet of a light transmission groove base material to form a light transmission groove;

a fixing hole forming step: cutting the outer shell at a proper position to form a fixing hole matched with the light transmission groove;

a light transmission groove fixing step: fixing the light transmission groove with the inner side of the outer shell, exposing the bottom of the light transmission groove from the surface of the outer shell by penetrating through the fixing hole, and fixing the edge of the opening of the light transmission groove with the edge of the fixing hole;

a light emitting band fixing step: fixing a light emitting band in the light transmission groove, and locating a light emitting surface of an LED lamp on the light emitting band at the bottom of the light transmission groove; and a helmet forming step: placing the light transmission groove in which the light emitting band is fixed and the outer wall in an inner shell forming mold, injecting an inner shell material, and carrying out pressure injection to form the helmet.

5. The luminous helmet manufacturing method of claim 4, wherein during the blister forming of the outer shell, an inward groove is formed in the surface of the outer shell, and a fixing strip composed of a part of groove walls is formed by cutting a side wall of the groove.

6. The luminous helmet manufacturing method of claim 5, wherein the depth of the fixing groove is equivalent to the height of the fixing strip.

7. A luminous helmet manufacturing method, comprising:

an outer shell forming step: carrying out blister forming on a PC sheet of a colored outer shell base material to form an outer shell with a groove;

a fixing hole forming step: cutting the outer shell at a proper position to form a fixing hole matched with a light transmission groove;

a light transmission groove forming step: carrying out blister forming on the PC sheet of a light transmission groove base material to form the light transmission groove matched with the fixing hole;

a light transmission groove fixing step: fixing the light transmission groove with the inner side of the outer shell, exposing the bottom of the light transmission groove from the surface of the outer shell by penetrating through the fixing hole, and fixing the edge of the opening of the light transmission groove with the edge of the fixing hole;

a light emitting band fixing step: fixing a light emitting band in the light transmission groove, and locating a light emitting surface of an LED lamp on the light emitting band at the bottom of the light transmission groove; and a helmet forming step: placing the light transmission groove in which the light emitting band is fixed and the outer wall in an inner shell forming mold, injecting an inner shell material, and carrying out pressure injection to form the helmet.

* * * * *